US008681047B2

(12) United States Patent
Egri et al.

(10) Patent No.: US 8,681,047 B2
(45) Date of Patent: Mar. 25, 2014

(54) SYSTEM AND METHOD TO FORM COHERENT WAVEFRONTS FOR ARBITRARILY DISTRIBUTED PHASED ARRAYS

(75) Inventors: Robert G. Egri, Carlisle, MA (US); Christopher C. Winter, Wayland, MA (US)

(73) Assignee: Cobham Defense Electronics Systems—M/A-Com, Bolton, MA (US)

( * ) Notice: Subject to any disclaimer, the term of this patent is extended or adjusted under 35 U.S.C. 154(b) by 401 days.

(21) Appl. No.: 12/913,558

(22) Filed: Oct. 27, 2010

(65) Prior Publication Data

US 2011/0102261 A1 May 5, 2011

Related U.S. Application Data

(60) Provisional application No. 61/258,114, filed on Nov. 4, 2009.

(51) Int. Cl.
*H01Q 3/02* (2006.01)

(52) U.S. Cl.
USPC ..... 342/368

(58) Field of Classification Search
CPC ..... H01Q 3/2658
USPC ..... 342/368, 371–372
See application file for complete search history.

(56) References Cited

U.S. PATENT DOCUMENTS

2010/0259447 A1* 10/2010 Crouch ..... 342/374
2011/0275308 A1* 11/2011 Grobert et al. ..... 455/1

OTHER PUBLICATIONS

M.I. Skolnik and D.D. King: "Self-phasing Array Antennas," IEEE AP-12, Mar. 1964.
Ralph C. Chernoff: "Large Active Retrodirective Arrays for Space Applications," IEEE AP-27, Jul. 1979.
Bernard D. Steinberg: "Phase Synchronizing a Nonrigid, Distributed, Transmit-Receive Radar Antenna Array," IEEE Trans. AES, Sep. 1982.
Bernard D. Steinberg and Eli Yadin: "Self-cohering and Airborne Radio Camera," IEEE AES-19, May 1983.
Bernard D. Steinberg: "Radar Imaging from a Distorted Array: The Radio Camera Algorithm," IEEE AP-29, Nov. 1981.
Prasanta Ghosh and Partha Banerjee: "A Simplified physical picture of phase conjugation using k-space formalism and ray optics", Americal Journal of Physics, Mar. 1993.

* cited by examiner

*Primary Examiner* — Harry Liu
(74) *Attorney, Agent, or Firm* — The Small Patent Law Group; Evan Reno Sotiriou

(57) ABSTRACT

A system and method for providing coherent sources for phased arrays are provided. One method includes providing a plurality of transceivers configured to transmit signals and defining an array of nodes. The method also includes providing a plurality of beacons at different frequencies to one of aim or focus phase coherent energy generated by the transmitted signals from the plurality of transceivers, wherein the phase coherent energy is transmitted at a direction and a frequency determined with phase conjugation and independent of the location of the plurality of beacons.

19 Claims, 8 Drawing Sheets

SYSTEM AND METHOD TO FORM COHERENT WAVEFRONTS FOR ARBITRARILY DISTRIBUTED PHASED ARRAYS

CROSS REFERENCE TO RELATED APPLICATIONS

This application claims priority to and the benefit of the filing date of U.S. Provisional Application No. 61/258,114 filed Nov. 4, 2009 for a "SYSTEM AND METHOD FOR PROVIDING COHERENT SOURCES FOR PHASED ARRAYS," which is hereby incorporated by reference herein in its entirety.

BACKGROUND OF THE INVENTION

The subject matter disclosed herein relates generally to systems and methods for array focusing, and more particularly to systems including beacons for coherent beam aiming.

It has long been the goal of sensor, jamming and communications systems to find practical methods to focus, or coherently combine signals coming from or directed to an array of spatially distributed transceivers where there is imprecise knowledge of either coordinates or mutual ranges. Some examples of such arrays of arbitrarily placed nodes may include communication or guidance systems, such as satellite systems, aircraft radar systems or hand-held radio systems. The wavelengths in these systems are either small relative to the separation of the transceivers or the system dynamics make it impractical to have transceivers cooperatively focus energy based on the instantaneous knowledge of relative position and timing. Even for a precisely surveyed phased array that is large physically when compared to the wavelength, the mechanical vibration of the structure may induce sufficient relative motion among the array elements to destroy coherence.

Thus, conventional systems are using retrodirectivity to cohere an array with a beacon that requires close placement of the beacon near the target area. In these systems, retrodirectivity is used to cohere the array by a reference beacon that is placed near the target and then by perturbing the transmit phases to steer the beam to a target slightly away from beacon. Since in retrodirectivity the beacon operates at the same frequency as the array, a passive reflector at or near the target location can also act as the phase reference.

BRIEF DESCRIPTION OF THE INVENTION

A method is provided for supplying arbitrarily distributed array elements in space, having unknown or only approximately known positions, with the instantaneous phase information that enables them to superimpose coherent transmitted or received energy on or from a given point in space. The method incorporates a set of beacons with well known positions that transmit the instantaneous phase information to the array elements using a set of frequencies calculated to transform to a specific phase when combined linearly and conjugated at each array element. The transformed phase is then used as a reference phase for transmission or receptions of signals to or from a given direction—or actually a given point in space. All signals at a certain frequency transmitted from the array elements starting with the transformed phase as the boundary reference will automatically cohere, or focus, at the target position. All signals at the same frequency received from a coherent source at the target position by the array elements and given the transformed phase boundary condition will add together coherently when sent to a common receiver.

In accordance with various embodiments, a method of array focusing is provided. The method includes providing a plurality of transceivers configured to transmit signals and defining an array of nodes. The method also includes providing a plurality of transceivers operating at an arbitrary frequency, different from that of the beacons, to one of aim or focus phase coherent energy generated by the transmitted signals from the plurality of transceivers, wherein the phase coherent energy is transmitted by the nodes at given direction and frequency independently of the location of the plurality of beacons.

In accordance with other embodiments, a system for array focusing is provided that includes a plurality of transceivers configured to transmit signals, wherein the plurality of transceivers defines an array of nodes. The system also includes a plurality of beacons configured to operate at different frequencies to one of aim or focus phase coherent energy generated by the transmitted signals from the plurality of transceivers of the array, wherein the phase coherent energy is transmitted at a direction and a frequency determined with phase conjugation and independently of the location of the plurality of beacons.

DETAILED DESCRIPTION OF THE INVENTION

Figure 1:
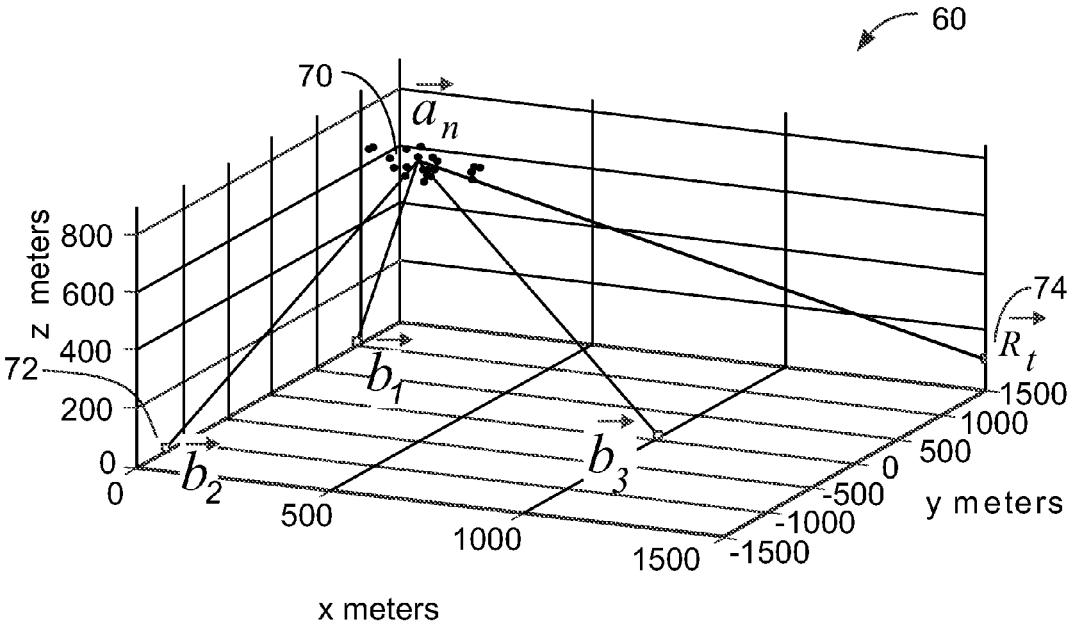
FIG. 1 is a diagram illustrating beam directing and focusing nodes of an array in accordance with various embodiments.

The foregoing summary, as well as the following detailed description of certain embodiments of the present invention, will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (e.g., processors or memories) may be implemented in a single piece of hardware (e.g., a general purpose signal processor or random access memory, hard disk, or the like) or multiple pieces of hardware. Similarly, the programs may be stand alone programs, may be incorporated as subroutines in an operating system, may be functions in an installed software package, and the like. It should be understood that the various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Various embodiments provide systems and methods using multiple beacons at different frequencies to aim and/or focus phase coherent energy at any direction and at any frequency. The focusing may be in the near field or in the far field. Various systems and methods described herein cohere energy from and/or to arbitrarily distributed phase array sources. Accordingly, coherent wavefronts for phased arrays may be provided.

Some examples of such arrays of arbitrarily placed nodes may include communication, radar, guidance or acoustical applications, such as, but not limited to the following:

1. Satellites in orbit forming a common steerable wavefront as in the Solar Power Satellite System;
2. UAVs, airships, balloons or naval surface vessels, operating as one coherent high resolution imaging radar or jammer;
3. Radar array elements on the outer skin of an aircraft forming inertially stabilized beam;
4. Group of hand-held radios carried by soldiers, or remote fixed base stations for communicating in both transmit and receive to large distances;
5. Spatially distributed lasers to generate steerable coherent power in warfare or in controlled fusion;
6. Underwater high resolution sonar array attached to a flexible structure;
7. Ultrasonic transceiver array to image the body of a patient, or forming a high intensity wave for surgery, etc.

FIG. 1 illustrates the main components of an embodiment of a system 60 shown as a three-dimensional (3D) plot. In the illustrated embodiment, $\vec{b}_1$, $\vec{b}_2$, $\vec{b}_3$, are beacons 72 placed at known positions. The target position 74 where the array should be focused is also known, denoted by $\vec{R}_t$. Additionally, the transceiver array nodes 70, $\vec{a}_n$ are shown dispersed randomly in 3D space.

In operation, each beacon 72 transmits a calibration signal to all transceiver nodes 70 at a frequency in accordance with the affine coefficients transforming the target point in a global system (such as the x, y, z axes in FIG. 1) to a skewed system spanned by the beacon vectors.

With the affine coefficients $c_1$, $c_2$, $c_3$ calculated relative to the skew coordinate system spanned by the beacon vectors $\vec{b}_1^{\,0}, \vec{b}_2^{\,0}, \vec{b}_3^{\,0}$ the unit vector $\vec{R}_t^{\,0}=c_1\vec{b}_1^{\,0}+c_2\vec{b}_2^{\,0}+c_3\vec{b}_3^{\,0}$, is formed, and is used to decompose the desired phasor $e^{+i\kappa|\vec{a}_n-\vec{R}_t|}$ into directly measured quantities. Using the affine coefficients, each beacon transmits the wave-numbers, $\kappa_1=\kappa c_1$, $\kappa_2=\kappa c_2$, $\kappa_3=\kappa c_3$, respectively, to the nodes.

Upon receiving the beacon signals and measuring a phasor representation of the received signals, each transceiver node 70 calculates a new phasor reference by combining each of the three measured phasors as described in more detail herein (using Equations 12, 13, 14, with full derivation of Equations 12, 13, 14 and detailed explanations provided below). This new phasor is the starting phase reference for the next transmission or reception of data to or from the direction of the target point $\vec{R}_t$.

Figure 2:
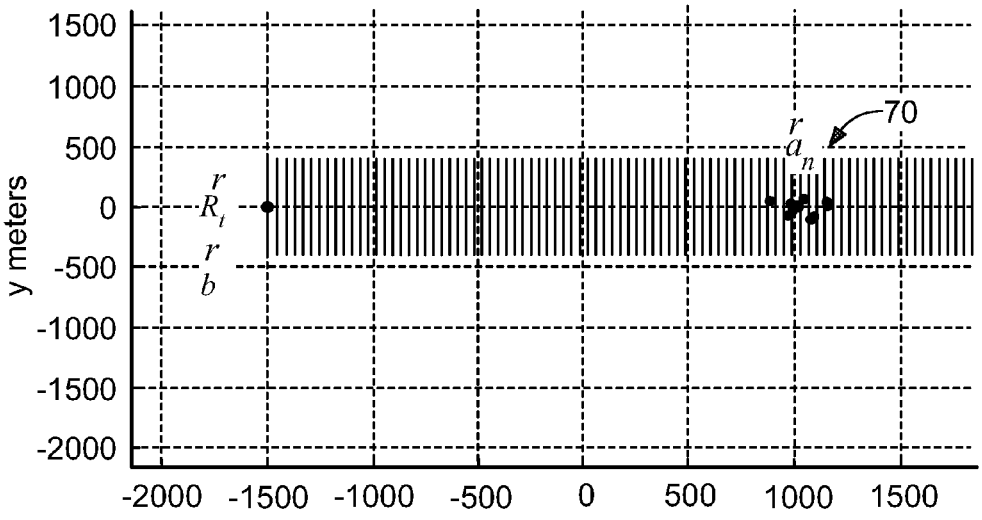
FIG. 2 is a diagram illustrating retro-directivity.
Figure 3:
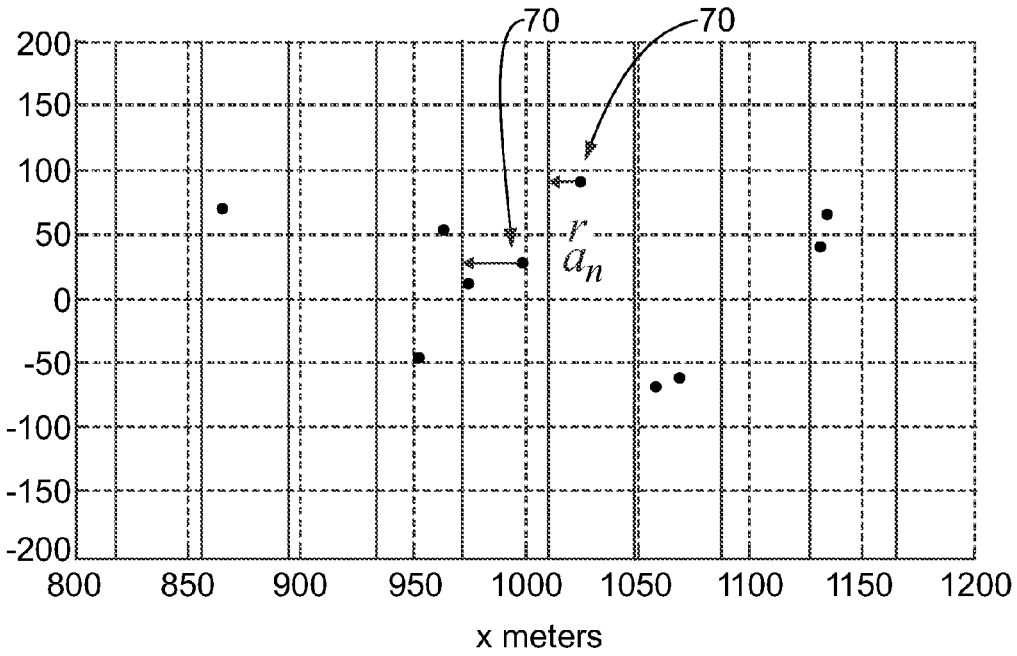
FIG. 3 is an expanded view of FIG. 2

In conventional single beacon phase conjugate retro-directivity systems, a beam is focused on a place or location where there has been a prior transmission. Single beacon retro-directivity (namely one-dimensional (1D) retro-directivity) works along the line of sight (LOS) vector to the beacon, with the ray vector being normal to the plane wave propagating to the ray vector. The measurements in a retro-directive system are illustrated in FIG. 2. In FIG. 2, the separation of the lines is one wavelength whose reciprocal, aside from a $2\pi$ factor, is the wave-number. The nodes 70, $\vec{a}_n$ receive the beacon signal and measure the phase of arrival. FIG. 3 illustrates this measurement in an expanded view for two of the nodes 70. Effectively, the nodes 70 measure the physical distance as a phase, between the nodes 70 and the last plane wave starting point (where phase equal zero relative to its emitter) in space. By conjugating these phasors and repeating the phasors, the nodes 70 can focus energy back to the source. Or, by repeating the phasors without conjugation, the nodes 70 can direct this energy to an image point that is along the same direction as the beacon signal propagates.

Figure 4:
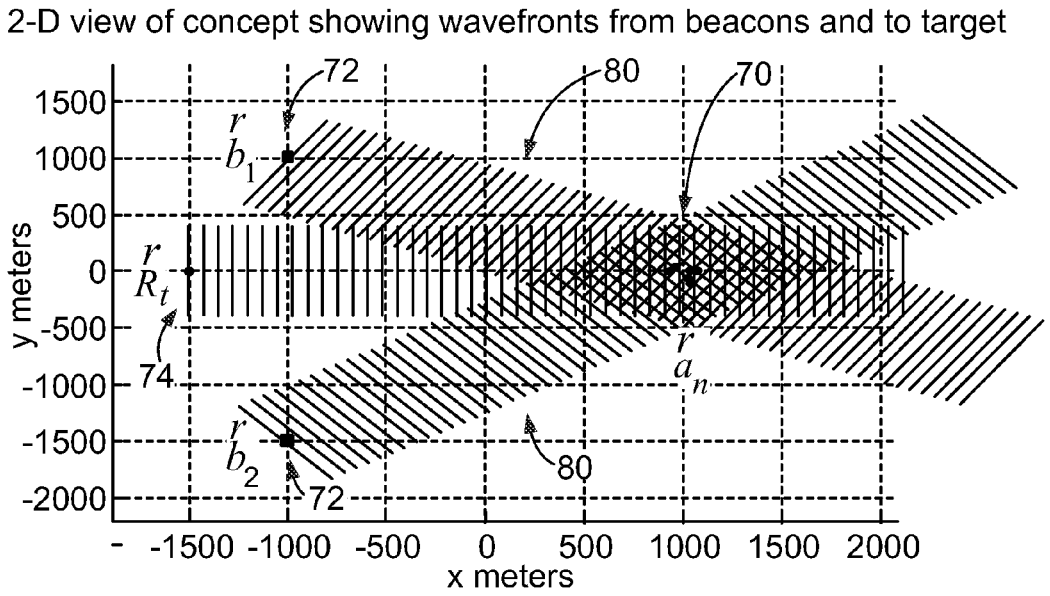
FIG. 4 is a diagram illustrating ray vectors and the use of different frequencies as phase references in accordance with various embodiments in the case of two dimensions (2D).
Figure 5:
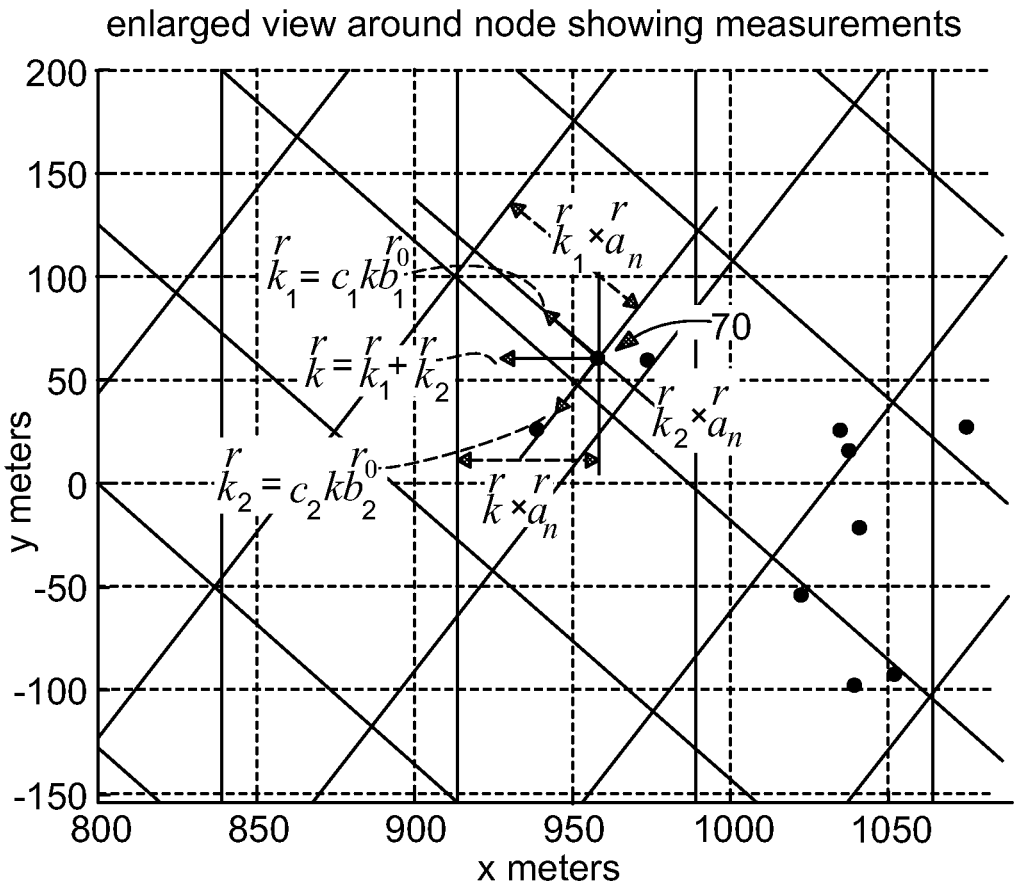
FIG. 5 is a diagram of a zoomed in view of FIG. 4 illustrating a detail view of FIG. 4 showing ray vectors of different frequencies used for phase measurements in accordance with various embodiments in the case of 2D.

In various embodiments, multiple references are used to steer the array. FIGS. 4 and 5 illustrate various embodiments of the system 60 and how cohering of energy to form wavefronts for phased array is provided. It should be noted that FIGS. 4 and 5 are illustrated in 2D for simplicity, i.e., only two beacons 72 are shown and all measurements are in a single plane. FIG. 4 is a full scale view showing two beacons 72 steering a beam from the array nodes 70 back to the target point 74. In this example, the two beacons 72 transmit waves at different frequencies to the nodes. The frequencies represented by the skewed planes correspond to the affine coefficients times the target frequency, where the coefficients are the coefficients that transform point $\vec{R}_t$ in x,y space to that spanned by the two beacon vectors, the latter being referenced to an arbitrary origin. The affine coordinate system grid is actually seen in the overlap region for the skewed plane waves emanating from $\vec{b}_1$ and $\vec{b}_2$. In FIG. 4, the desired wavefronts are represented as vertical lines, which are projected to the target 74 by the nodes 70. The beacons 72 transmit the signals represented by the skewed, but parallel lines.

FIG. 5 is a diagram zoomed in on the region around the nodes 70, illustrating the ray vectors and the distances of the node $\vec{a}_n$ to the nearest wavefronts. These distances are equal within an integer number of wavelengths to the scalar products $\vec{\kappa}_1\cdot\vec{a}_n$, $\vec{\kappa}_2\cdot\vec{a}_n$, $\vec{\kappa}\cdot\vec{a}_n$ of the node location vector $\vec{a}_n$ and the respective ray vectors. When only phase measurement is used, the arbitrary integer number of wavelengths at the respective frequencies can be ignored, and hence pure phase measurements with wave-numbers $\vec{\kappa}_1$ and $\vec{\kappa}_2$ can represent the linear sum of the desired phase in the direction of $\vec{\kappa}$, which is described in more detail below with Equation 14.

It should be noted that in FIGS. 2, 3, 4, 5, the wavefronts 80 are drawn as planes (lines) for simplicity. However, these wavefronts 80 are spherical and approximating the sphere with a plane causes phase error that should be compensated for when the beacons or target are near the nodes. Equation 13 herein provides the quadratic correction for the plane wave (linear) approximation.

Figure 6:
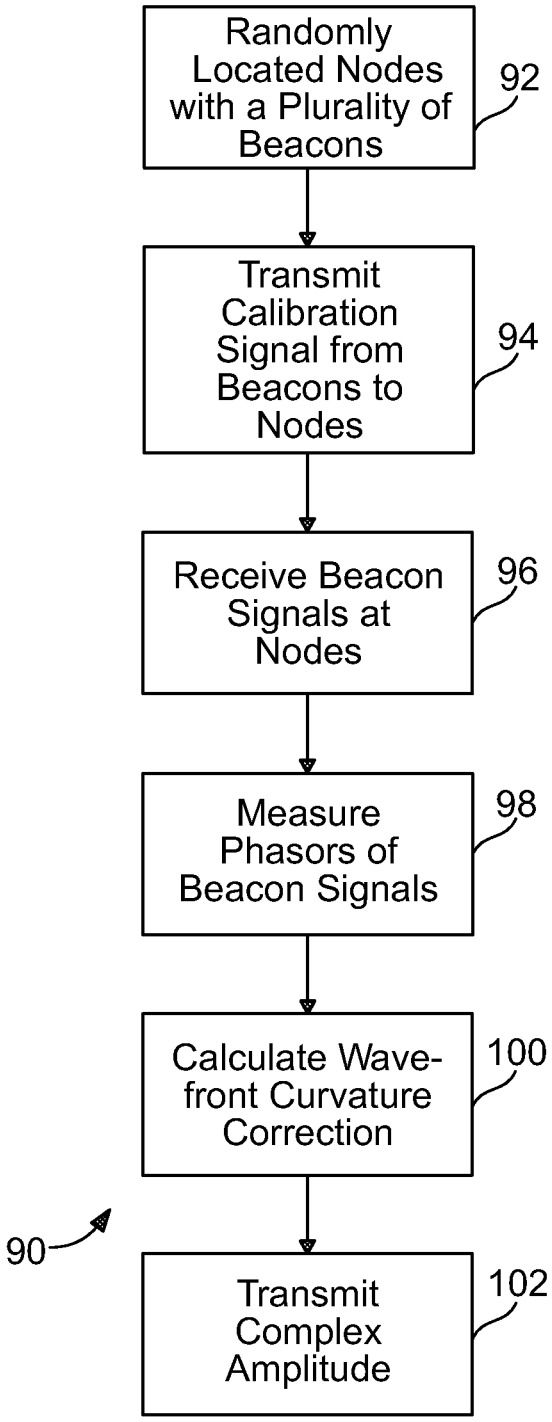
FIG. 6 is a flowchart of method for performing array focusing to generate coherent wavefronts in accordance with various embodiments.

Various embodiments provide a method 90 as illustrated in FIG. 6 to perform array focusing, which in various embodiments includes phase aligning a plurality of nodes to create a coherent wavefront as describe herein. In accordance with various embodiments, the method 90 produces a wavefront from each element that constructively adds with the wavefronts from the other array transceivers at an arbitrary direction and point in space instead of reconstructing a wavefront back at the original source as a conjugated reflection from the reference source.

Specifically, in some embodiments, the method 90 includes phase alignment of the nodes to create the coherent wavefront as follows:

1. Referencing an arbitrary target location relative to a plurality of randomly located nodes with a plurality of beacons at 92. This includes, in various embodiments, decomposing a target direction $\vec{R}_t^0$ vector in the affine coordinate system spanned by the beacon unit vectors $\vec{b}_1^0, \vec{b}_2^0, \vec{b}_3^0$: $\vec{R}_t^0 = c_1\vec{b}_1^0 + c_2\vec{b}_2^0 + c_3\vec{b}_3^0$, if there are three beacons.

2. Transmit a calibration signal from the beacons to the nodes at 94, for example, from beacon j at wave-number $\kappa_j = \kappa|c_j|$ to the nodes.

3. Receive beacon signals at the nodes at 96, for example, receive the signals at node n and measure the phasor of the received beacons signals at 98. For example, the phasor $p_{nj} = e^{-i\kappa_j|\vec{a}_n - \vec{b}_j|}$ may be measured.

4. Thereafter, if beacon or target is in near field of the array, calculate the wavefront curvature correction ($e^{i\Theta_{n0}}$) at 100.

5. Then, transmit the complex amplitude (as a signal) at 102, for example, transmit the complex amplitude $E_n = e^{i\Theta_{n0}} s_{n1} s_{n2} s_{n3}$ from node n, where $$s_{nj} = \begin{cases} \bar{p}_{nj} & \text{if } c_j > 0 \\ p_{nj} & \text{if } c_j < 0 \end{cases}$$

Thus, in operation, a plurality of randomly located nodes may be used with a plurality of primary beacons, for example, three primary beacons and the selection of the corresponding calibration frequencies, with all focusing errors induced by inaccurate localization of the array nodes reduced or eliminated. It should be noted that the same transceivers that can form a phase coherent wavefront in transmit mode can also form the same in receive mode. Thus, the various embodiments may be employed for localizing an unknown emitter within diffraction limit. It also should be noted that various embodiments, being dependent only on wave propagation to form a coherent wavefront from remote nodes also may be employed, for example, in underwater sonar or for in vivo ultrasound medicine (e.g., imaging, jamming, surgery, etc.) to the extent that the propagating medium can be taken as approximately homogeneous and isotropic.

It further should be noted that applications that need a coherent phase wavefront to be formed with remote mobile nodes have functions that need to be executed almost simultaneously, and may include: exchange of control information via a data network, clock and phase synchronization, amplitude control etc.

Schemes or methods of array focusing involve aligning spherical wave point sources so that at the desired location the individual waves arrive at the same phase. To this extent, the schemes involve the establishment of complete phase coherence among several emitters irrespective of the locations of the emitters.

It also should be noted that one beacon ray vector cannot determine an arbitrary line of sight (LOS) vector in three dimensions where three independent vectors are needed to form a reference frame. In various embodiments, the plurality of beacons, for example, three beacons 72 (as illustrated in FIG. 1) or more are used to provide redirection into any direction without loss of coherence. The beacons do not need to be stationary or be the same as the nodes, but be able to operate at frequencies that depend on the direction in which the beam is to be focused, as will be described below. It further should be noted that in general, it is easier to have the array focused to infinity (Fraunhofer limit), but the methods of the various embodiments can also be used for near field focusing (Fresnel limit), as well. When the beacons and/or target are in the far field and the array is focused by the various embodiments, source locations of the array are not needed, and correction of the wavefront curvature is provided using, for example, low precision location estimates only if either the beacon(s) or the target are in the near-field.

Decomposition of the desired ray vector is provided by projecting the ray vector into the directions of three non-coplanar vectors as described in more detail herein. However, the number of projected peaks and valleys per unit length, which is the apparent wave number, from beacon to node changes with the angle of projection. Accordingly, the same representation of the wave number is generated along the LOS between the beacon and node using different beacon transmission frequencies from that of the array to target. In some embodiments, three primary beacons (although more or fewer may be used as described herein) and selection of the corresponding calibration frequencies reduces or eliminates almost all or all focusing errors induced by inaccurate localization of the array nodes.

The beacons 72 (illustrated in FIG. 1) also may be used as test receivers to verify the coherence of the array. The various embodiments allow the use of fixed emitters and secondary beacons operating at frequencies not under the control of the array, so long as there are three additional primary beacons with adjustable location dependent frequencies. The use of the fixed frequency secondary beacons assists in changing the calibration frequencies of the primary beacons to more convenient or desired ones, if needed. To compensate for short term, wind or vibration induced node to node range fluctuation that may cause array phase decoherence, 3-axis integrating accelerometers may be attached to each antenna of the transceivers and are used to measure motions over a short time period (e.g., about one second), then nulled after direct phase measurement between the nodes as described in more detail herein.

Thus, precise knowledge of the node positions of the phase synchronized nodes is not needed where the cohered beam is aimed in the direction of the beacon and as such is of narrow bandwidth in both temporal and spatial sense, having the same carrier frequency and same direction. In various embodiments, using a plurality of beacons, for example, three beacons, the beam can be directed in any direction or focused in any location. This is in contrast to retro-directivity where perfect focusing may be achieved only at the location of the reference beacon.

It should be noted that the same principle of phase cohering to generate and point a diffraction limited beam in accordance with various embodiments is applicable both for long range communications and imaging radar. In the former, for example, several radios of a group or squad may be made phase coherent and communicate at longer ranges while simultaneously jam at narrowly targeted locations. Imaging radar is another application that includes cohering the radars of several and remote airships or satellites, for example, that can cooperatively detect surface skimming missiles against oceanic clutter, or cohering remotely piloted aircraft trying to image tanks against ground clutter, etc. Thus, although the various embodiments may be described in connection with certain applications, the various embodiments are not so limited. For example, the various embodiments may be implemented in different applications, such as jamming applications, communication applications, and radar or imaging applications, among others.

In various embodiments, the plurality of beacons may be positioned at any location, and need not be placed near a target area. Accordingly, various embodiments provide for randomly and/or remotely locating transceivers that operate as coherent sources for phased arrays. In general, the various embodiments implement the following steps to align the array before transmitting the coherent wavefront:

1. The transceivers (array nodes) are completely frequency locked from one to another, which involves:

a. node to node exchange of frequency acquisition signals; and b. tracking to remove motion induced Doppler shifts.

2. The transceivers are phase locked from one to another in the sense that relative to a hypothetical inertially located source, all source oscillators are also in phase.

a. By different means the nodes discover residual relative phases proportional to the mutual ranges that remain after establishing frequency tracking (phased array needs phase information), but without the need to know explicitly what these ranges are.

3. A plurality of beacons, for example, three beacons are used to measure array phase distribution as function of direction:

a. Beacons to form reference frame for any target.

b. Beacons transmit calibration signals at appropriate frequencies for array phase alignment.

4. Nodes measure the arrival phases of the calibration signals.

5. Nodes calculate phase curvature to compensate for near field focusing error.

6. Array of nodes periodically transmits coherent wavefront in the direction of the beacons that will verify that the array is phase coherent. In this closed loop, beacons to array to beacons process may run simultaneously with other functions when several transceivers reside in one node.

It should be noted that radio(s) may be configured to provide signal processing and communications using control protocols as desired or needed.

The various embodiments may be implemented to provide node to node frequency synchronization and tracking, node to node phase synchronization and tracking, beacon to node frequency synchronization and tracking, array alignment and beam pointing. The various implementations may be based on particular conditions, for example, moving platforms, oscillator phase noise, external and multipath interference, etc.

Variations and modifications to the various embodiments are contemplated. Appropriate communication and control protocols also may be provided as described herein to execute such tasks in real time in, for example, a field-programmable gate array (FPGA) and digital signal processor (DSP) of the node.

In general, the phases of the nodes 70 are maintained synchronous with each other at all times. A phased array with operation based on knowing the positions of the radiators, while attempting to focus a beam, should also know these positions within a fraction of the wavelength at all times because the emitters must adjust the radiated phases so that the waves may arrive in phase from all nodes at the given location. If the transmission wavelength is λ then the position precision should be better than $$\frac{1}{4}\lambda.$$

However, in accordance with various embodiments, using beacons and a self-aligning technique, whereby only the beacon to node phase measurements are used, not node positions, the above position knowledge is not needed.

In particular, any wave emitted with amplitude $E_n=|E_n|e^{i\xi_n}$ and frequency $$\omega = \frac{2\pi}{\lambda}c = \kappa c$$

from node n propagating from the source at location $\vec{a}_n$ to a target location $\vec{R}_t$ at time instant t is represented by the complex amplitude of a spherical wave $$F_n = \frac{1}{|\vec{a}_n - \vec{R}_t|}E_n e^{i\omega t}e^{-i\kappa|\vec{a}_n-\vec{R}_t|}.$$

To form a coherent focused beam, each node 70 must transmit a signal with such phase so that at the desired spot or area all waves arrive at the same phase. To achieve this, first the nodes 70 are made completely phase synchronous with each other after which each node 70 can set its individual transmit phase arbitrarily and independently of the others to achieve perfect focusing as described by the algorithm herein. The waves from all nodes 70 arrive in phase at location $\vec{R}_t$ if the transmitted phase at node n is where $\xi_n=\kappa|\vec{a}_n-\vec{R}_t|+\xi_0$, where $\xi_0$ is an arbitrary fixed phase and being common to all nodes we can ignore from here on without affecting focusing, in which case $$F_n = \frac{1}{|\vec{a}_n - \vec{R}_t|}|E_n|e^{i\omega t}.$$

If the locations $\vec{a}_n$ were known precisely, and $\vec{R}_t$ is given then each node 70 could calculate its proper transmit phase $\xi_n=\kappa|\vec{a}_n-\vec{R}_t|$ and the array would be focused at $\vec{R}_t$. Alternatively, if the node locations are not known explicitly, but by some indirect means, the nodes 70 can measure the required phases $\xi_n$ that would also be sufficient to focus at the target point 74.

In accordance with various embodiments, phase synchronization is provided. Specifically, after frequency synchronization is established and node to node ranges are measured, pairs of nodes 70 exchange tones to discover and correct for the range dependent relative oscillator phase of the nodes 70. For example, if two nodes, A and B are to be synchronized, let the range delay between the nodes be $$\tau_{AB} = \frac{1}{c}\left|\vec{R}_A - \vec{R}_B\right|.$$

If node A emits the wave exp $[l(\omega t+\phi_A)]$, where $\phi_A$ is the local oscillator's initial phase in node A relative to some hypothetical global clock, this wave arrives at node B delayed by $$\tau_{AB} = \frac{1}{c}\left|\vec{R}_A - \vec{R}_B\right|$$

as exp $[l(\omega(t-\tau(t-\tau_{AB})+\phi_A)]$. The received wave is down-converted by the node's local oscillator exp $[l(\omega t+\phi_B)]$ that runs at the same rate as that of node A, but with a different initial phase $\phi_B$. The result is the following phasor:

$$y(B\leftarrow A)=e^{l(\omega(t-\tau_{AB})+\phi_A)}e^{-l(\omega t+\phi_B)}=e^{l(-\omega\tau_{AB}+\phi_A-\phi_B)} \quad \text{Eq. 1}$$

Some time $t_1$ later, node B sends out a wave at frequency $\omega$, which can be done because of frequency synchronism, and let node A down-convert the wave to:

$$y(A\leftarrow B)=e^{l(\omega(t-t_1-\tau_{AB})+\phi_B)}e^{-l(\omega(t-t_1)+\phi_A)}=e^{l(-\omega\tau_{AB}-\phi_A+\phi_B)} \quad \text{Eq. 2}$$

It should be noted that the results of the two down-conversions are not the same because the results depend differently on their relative phases, but if one is multiplied with the conjugate of the other, the result is a complex number that depends only on the difference of these phases and not on the propagation delay between the nodes, which is as follows:

$$\begin{aligned} z_{AB} &= y(B\leftarrow A)\cdot\overline{y(A\leftarrow B)} \\ &= e^{l(-\omega\tau_{AB}+\phi_A-\phi_B)}e^{-l(-\omega\tau_{AB}-\phi_A+\phi_B)} \\ &= e^{l2\phi_{AB}} \end{aligned} \quad \text{Eq. 3}$$

Figure 7:
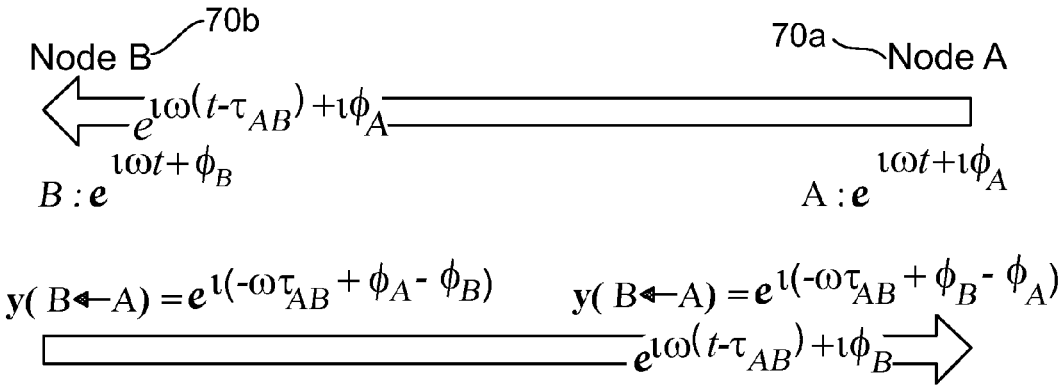
FIG. 7 is a diagram illustrating node to node phase synchronization in accordance with various embodiments.

If node B transmits the result of its measurement y(B←A) to node A, then after the latter having measured y(A←B), node A can deduce or determine the relative phase shift between the nodes by using Equation 3, and then set its clock phase back by the half angle of $z_{AB}$. The nodes 70 can perform this process back and forth to improve on the measurement by averaging, if needed. In various embodiments, most or all node pairs go through the same procedure and thereby have clocks that are synchronized and not just operating at the same rate. In particular, only a subset of the node pairs are needed because being in "phase synchronism" is transitive: if A is synchronous with B and B is synchronous with C, then A is synchronous with C. The node pairs to be synchronized may be determined by the particular protocol. FIG. 7 illustrates node to node phase synchronization between nodes 70*a* and 70*b*.

In particular, the location of the desired array focus is denoted by $\vec{R}_t=|\vec{R}_t|\vec{R}_t^{\,0}$, and by $\vec{R}_t^{\,0}$ the unit vector in the same direction, $|\vec{a}_n-\vec{R}_t|$ is expanded while keeping only the quadratic term in $|\vec{a}_n|$ in its Taylor series. Starting from the following $$\sqrt{1+\varepsilon} = 1+\frac{1}{2}\varepsilon-\frac{1}{8}\varepsilon^2+\ldots\approx 1+\frac{1}{2}\varepsilon \quad \text{if } |\varepsilon|\ll 1,$$

the following expansion results:

$$\begin{aligned} \left|\vec{a}_n-\vec{R}_t\right| &= \sqrt{|\vec{a}_n|^2+|\vec{R}_t|^2-2\vec{a}_n\cdot\vec{R}_t} \\ &= |\vec{R}_t|\sqrt{1-2\frac{1}{|\vec{R}_t|}\vec{a}_n\cdot\vec{R}_t^{\,0}+\frac{|\vec{a}_n|^2}{|\vec{R}_t|^2}} \\ &= |\vec{R}_t|\left(\begin{array}{c} 1-\frac{1}{|\vec{R}_t|}\vec{a}_n\cdot\vec{R}_t^{\,0}+\frac{|\vec{a}_n|^2}{2|\vec{R}_t|^2}- \\ \frac{1}{2}\frac{1}{|\vec{R}_t|^2}\left(\vec{a}_n\cdot\vec{R}_t^{\,0}\right)^2+ \\ \frac{1}{2}\frac{|\vec{a}_n|^2}{|\vec{R}_t|^3}\left(\vec{a}_n\cdot\vec{R}_t^{\,0}\right)-\frac{1}{8}\frac{|\vec{a}_n|^4}{|\vec{R}_t|^4}+\ldots \end{array}\right) \end{aligned} \quad \text{Eq. 5}$$

Figure 8:
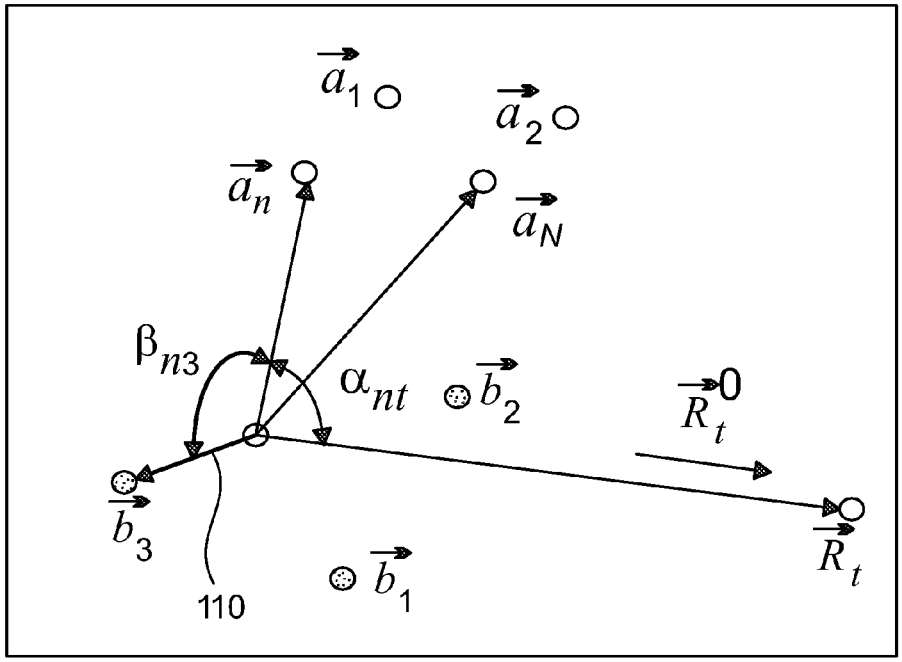
FIG. 8 is a diagram illustrating beam directing and focusing nodes of an array in accordance with various embodiments.

FIG. 8 illustrates that nodes of the array that are to be focused at point $\vec{R}_t$ are located at $\vec{a}_n$. To facilitate focusing, beacons may be placed at $\vec{b}_1$, $\vec{b}_2$ and $\vec{b}_3$, wherein the vectors 110 are referenced to an arbitrary point in inertial space.

If $\vec{a}_n\cdot\vec{R}_t^{\,0}=|\vec{a}_n|\cos\alpha_{nt}$, then the phase delay from the node n to the target at the instant of arrival is as follows:

$$\begin{aligned} -\omega\tau_n &= -\frac{\omega}{c}|\vec{R}_t|\left(1-\frac{1}{|\vec{R}_t|}\vec{a}_k\cdot\vec{R}_t^{\,0}+\frac{|\vec{a}_n|^2\sin^2\alpha_{nt}}{2|\vec{R}_t|^2}+\ldots\right) \\ &= -\kappa|\vec{R}_t|+\kappa\vec{a}_n\cdot\vec{R}_t^{\,0}-\kappa\frac{|\vec{a}_n|^2\sin^2\alpha_{nt}}{2|\vec{R}_t|}+\ldots \end{aligned} \quad \text{Eq. 6}$$

The term $\kappa|\vec{R}_t|$ is common to all waves in the sum of the waves from all the nodes 70 and will have no effect on the amplitude of the resulting interference pattern, and thus can be ignored. The $2^{nd}$ term linear in the node location is the plane wave $\kappa\vec{a}_n\cdot\vec{R}_t^{\,0}$, while the $3^{rd}$ term $$-\kappa\frac{|\vec{a}_n|^2\sin^2\alpha_{nt}}{2|\vec{R}_t|}$$

is the quadratic (parabolic) correction to the plane wave approximation of a spherical wave.

Accordingly, in these embodiments, beacon referenced alignment is provided as shown in FIG. 8. In order to avoid using the node locations to cohere the beam, but employ a technique that uses only directly measurable propagation quantities from emissions of a fixed set of beacons to form a coherent wavefront, the desired transmit phases of the nodes are decomposed into the linear combinations of the received phases from the reference beacons, as if the transmit phases were vectors. Specifically, to provide phase decomposition, it is assumed that all of the nodes and beacons have already been made frequency coherent with each other. At location $\vec{b}_j$ an emitter is positioned, and the array node n receives the calibration signals at the locations $\vec{a}_n$ where the nodes of the array are located and the phasor $E'_n=e^{+\iota\kappa|\vec{a}_n-\vec{R}_t|}$ is to be generated at node n based on the measurements from transmissions provided by the beacons.

Starting with the expansion $$|\vec{a}_n-\vec{R}_t|=|\vec{R}_t|-\vec{a}_n\cdot\vec{R}_t^0+\frac{|\vec{a}_n|^2\sin^2\alpha_{nt}}{2|\vec{R}_t|}+\ldots \quad \text{Eq. 8}$$

the unit vector $\vec{R}_t^0$ pointing in the direction of the target is expressed in the affine base spanned by the unit vectors that point to the beacons, all relative to a fixed, common but arbitrary origin, as follows:

$$\vec{R}_t^0=c_1\vec{b}_1^0+c_2\vec{b}_2^0+c_3\vec{b}_3^0 \quad \text{Eq. 9}$$

With the affine coefficients $c_1$ $c_2$, $c_3$ calculated relative to the skew coordinate system spanned by the beacon vectors $\vec{b}_1^0$, $\vec{b}_2^0$, $\vec{b}_3^0$, the unit vector $\vec{R}_t^0=c_1\vec{b}_1^0+c_2\vec{b}_2^0+c_3\vec{b}_3^0$ is formed, and is used to decompose the desired phasor $e^{+\iota\kappa|\vec{a}_n-\vec{R}_t|}$ into directly measured quantities. To this end, the distance from node n to beacon j, j=1, 2, 3, is expanded as follows:

$$|\vec{a}_n-\vec{b}_j|=|\vec{b}_j|-\vec{a}_n\cdot\vec{b}_j^0+\frac{|\vec{a}_n|^2\sin^2\beta_{nj}}{2|\vec{b}_j|}+\ldots \quad \text{Eq. 10}$$

$$\vec{a}_n\cdot\vec{b}_j^0=|\vec{b}_j|-|\vec{a}_n\cdot\vec{b}_j|+\frac{|\vec{a}_n|^2\sin^2\beta_{nj}}{2|\vec{b}_j|}+\ldots$$

and thus:

$$\begin{aligned}|\vec{a}_n-\vec{R}_t|&=|\vec{R}_t|-\vec{a}_n\cdot\left(c_1\vec{b}_1^0+c_2\vec{b}_2^0+c_3\vec{b}_3^0\right)+\frac{|\vec{a}_n|^2\sin^2\alpha_{nt}}{2|\vec{R}_t|}+\ldots=\\ &|\vec{R}_t|-\left(c_1\vec{a}_n\cdot\vec{b}_1^0+c_2\vec{a}_n\cdot\vec{b}_2^0+c_3\vec{a}_n\cdot\vec{b}_3^0\right)+\frac{|\vec{a}_n|^2\sin^2\alpha_{nt}}{2|\vec{R}_t|}+\ldots=\\ &|\vec{R}_t|-\left(c_1|\vec{b}_1|+c_2|\vec{b}_2|+c_3|\vec{b}_3|\right)+\\ &\left(c_1|\vec{a}_n-\vec{b}_1|+c_2|\vec{a}_n-\vec{b}_2|+c_3|\vec{a}_n-\vec{b}_3|\right)-\\ &\left(c_1\frac{|\vec{a}_n|^2\sin^2\beta_{n1}}{2|\vec{b}_1|}+c_2\frac{|\vec{a}_n|^2\sin^2\beta_{n2}}{2|\vec{b}_2|}+c_3\frac{|\vec{a}_n|^2\sin^2\beta_{n3}}{2|\vec{b}_3|}\right)+\\ &\frac{|\vec{a}_n|^2\sin^2\alpha_{nt}}{2|\vec{R}_t|}+\ldots\end{aligned} \quad \text{Eq. 11}$$

To simplify the formulas and equations, the following notations are provided, namely the phasor:

$$p_{nj}=\exp[-\iota\kappa c_j|\vec{a}_n-\vec{b}_j|] \quad \text{Eq. 12}$$

and the phase common to all nodes as $\theta_0=\kappa|\vec{R}_t|-\kappa(c_1|\vec{b}_1|+c_2|\vec{b}_2|+c_3|\vec{b}_3|)$, and the wavefront curvature compensation for node n:

$$\theta_{n0}=-\kappa\left(c_1\frac{|\vec{a}_n|^2\sin^2\beta_{n1}}{2|\vec{b}_1|}+c_2\frac{|\vec{a}_n|^2\sin^2\beta_{n2}}{2|\vec{b}_2|}+c_3\frac{|\vec{a}_n|^2\sin^2\beta_{n3}}{2|\vec{b}_3|}\right)+\kappa\frac{|\vec{a}_n|^2\sin^2\alpha_{nt}}{2|\vec{R}_t|}+\ldots \quad \text{Eq. 13}$$

Then, using Equation 11 with the affine coefficients of the target in the coordinate system fixed by the beacons, the desired phasor of node n, $E'_n=e^{+\iota\kappa|\vec{a}_n-\vec{R}_t|}$, is expanded as follows:

$$\begin{aligned}E'_n&=\exp\left[\iota\kappa\left(\begin{array}{c}|\vec{R}_t|-\left(c_1|\vec{b}_1|+c_2|\vec{b}_2|+c_3|\vec{b}_3|\right)+\\ \left(c_1|\vec{a}_n-\vec{b}_1|+c_2|\vec{a}_n-\vec{b}_2|+c_3|\vec{a}_n-\vec{b}_3|\right)-\\ \left(c_1\frac{|\vec{a}_n|^2\sin^2\beta_{n1}}{2|\vec{b}_1|}+c_2\frac{|\vec{a}_n|^2\sin^2\beta_{n2}}{2|\vec{b}_2|}+c_3\frac{|\vec{a}_n|^2\sin^2\beta_{n3}}{2|\vec{b}_3|}\right)+\\ \frac{|\vec{a}_n|^2\sin^2\alpha_{nt}}{2|\vec{R}_t|}+\ldots\end{array}\right)\right]\\ &=\exp\left[\iota\kappa\left(\begin{array}{c}|\vec{R}_t|-\left(c_1|\vec{b}_1|+c_2|\vec{b}_2|+c_3|\vec{b}_3|\right)-\\ \left(c_1\frac{|\vec{a}_n|^2\sin^2\beta_{n1}}{2|\vec{b}_1|}+c_2\frac{|\vec{a}_n|^2\sin^2\beta_{n2}}{2|\vec{b}_2|}+c_3\frac{|\vec{a}_n|^2\sin^2\beta_{n3}}{2|\vec{b}_3|}\right)+\\ \frac{|\vec{a}_n|^2\sin^2\alpha_{nt}}{2|\vec{R}_t|}+\ldots\end{array}\right)\right]\\ &\overline{p}_{n1}\overline{p}_{n2}\overline{p}_{n3}\\ &=e^{\iota\theta_0}E_n\\ &=e^{\iota\theta_0}e^{\iota\theta_{n0}}\overline{p}_{n1}\overline{p}_{n2}\overline{p}_{n3}\end{aligned} \quad \text{Eq. 14}$$

Finally, the complex node phasor of interest is:

$$E_n=e^{\iota\theta_{n0}}\mathbf{0}s_{n1}s_{n2}s_{n3} \quad \text{Eq. 15}$$

Here, $s_{nj}=\overline{p}_{nj}$, and $p_{nj}=\exp[-\iota\kappa c_j|\vec{a}_n-\vec{b}_j|]$ is the phasor that is to be measured using the beacon j for given κ and $c_j$, and the overbar denotes complex conjugation. This phasor can be provided directly by measurement if the wave-number of the beacon's transmission is $\kappa_j=\kappa c_j$, because in that case, aside from the arbitrary initial beacon phase common to all nodes when received, $\exp[-\iota\kappa c_j|\vec{a}_n-\vec{a}b_j|]=\exp[-\iota\kappa_j|\vec{a}_n-\vec{a}b_j|]$ is exactly the propagation phasor between the beacon j and the node n.

Since the $e^{\iota\Theta_0}$ is common to all nodes 70, when synthesizing the array, this factor only shifts the composite waveform by a fixed phase and may be omitted as having no effect on the pattern.

To compensate for the wavefront curvature error when either the beacons 72 or the target 74 are in the near field of the array, the phase factor $e^{\iota\Theta_{n0}}$ is maintained, where:

$$\theta_{n0}=-\left(\kappa_1\frac{|\vec{a}_n|^2\sin^2\beta_{n1}}{2|\vec{b}_1|}+\kappa_2\frac{|\vec{a}_n|^2\sin^2\beta_{n2}}{2|\vec{b}_2|}+\kappa_3\frac{|\vec{a}_n|^2\sin^2\beta_{n3}}{2|\vec{b}_3|}\right)+ \quad \text{Eq. 16}$$

-continued $$\kappa\frac{|\vec{a}_n|^2\sin^2\alpha_{nt}}{2|\vec{R}_t|}+\ldots$$

The following should be noted:

1. All true frequencies, wave numbers are always positive. When some of the affine coefficients are negative that transmissions would appear to have to occur with negative frequencies $\kappa_j=\kappa c_j$, which cannot be performed, and instead when $c_j<0$ transmission is provided at $\kappa_j=\kappa|c_j|>0$ that will result in the phasor $p_{nj}^{+}=\exp[-\iota\kappa|c_j||\vec{a}_n-\vec{b}_j|]$. To generate $e^{+\iota\kappa|\vec{a}_n-\vec{R}_t|}$ the decomposition uses the phase $\kappa c_j|\vec{a}_n-\vec{b}_j|=-\kappa_j|\vec{a}_n-\vec{b}_j|$, which means that in this case the phasor $p_{nj}^{+}$ itself and not its complex conjugate determines $E_n$ after the beacon to node measurement.

2. Phase error and phase noise show up in the measurement of the $p_{nj}$ phasor as $p_{nj}=\exp[-\iota\kappa c_j|\vec{a}_n-\vec{b}_j|+\epsilon_{nj}]$, where $\epsilon_{nj}$ is an additive phase error term representing frequency synthesizer noise, as well as other possible noise. The phase error in $p_{nj}$, does not get multiplied by the frequency of operation and is also independent of the precision with which node locations are known. The various embodiments, thus, avoid the need for precise node positions by transforming the positions to a beacon referenced phase measurement that is less sensitive to errors.

3. By having the beacons transmit with common wavenumber $\kappa$, the measuring the propagation phasor $\rho_{nj}=\exp[-\iota\kappa|\vec{a}_n-\vec{b}_j|]$ and then calculating by taking the $c_j^{th}$ power $(\rho_{nj})^{c_j}$ cannot be used because the affine coefficients $c_j$ are generally not integers, but arbitrary real numbers, and non-integer powers of complex numbers cannot be defined unambiguously: if $z_1=(\rho_{nj})^{c_j}$ is one calculated value, then $z_1e^{\iota L2\pi c_j}$ is also equally good for any integer L. If $c_j$ is an integer, these values coincide, but when this is not the case the several values cannot be reconciled among the nodes 70 to a common set.

4. The dominant linear phase term of Equation 12 depends on the location of the nodes 70, but is directly measured during the beacon 72 to node 70 transmission without the need to know where the node 70 is relative to the beacon 72. Unlike the linear phase term of Equation 12, the quadratic phase correction in Equation 16 is not measured, but calculated by the nodes 70, and explicitly depends on the positions of the nodes 70. It should be noted that up to frequencies of several GHz, even crude GPS location estimates accurate only within tens of wavelengths are sufficient in Equation 12 to compensate for this quadratic error when the target 74 or the beacons 72 are in the near field of the array.

When the nodes transmit with amplitudes $E_n=e^{\iota\theta_{n0}}\bar{p}_{n1}\bar{p}_{n2}\bar{p}_{n3}$ (see Equation 15), the composite signal at the target location $\vec{R}_t$ is the sum of the spherical waves emitted from all the nodes 70:

$$E(\vec{R}_t)=\sum_k\frac{E_n}{|\vec{a}_n-\vec{R}_t|}e^{-\iota\kappa|\vec{a}_n-\vec{R}_t|}\propto \qquad \text{Eq. 17}$$

$$\sum_n e^{\iota\theta_{n0}}\frac{\bar{p}_{n1}\bar{p}_{n2}\bar{p}_{n3}}{|\vec{a}_n-\vec{R}_t|}\exp\left[-\iota\kappa\vec{a}_n\cdot\vec{R}_t^0+\iota\kappa\frac{|\vec{a}_n|^2\sin^2\alpha_{nt}}{2|\vec{R}_t|}+\ldots\right]$$

Modifications and variations are contemplated. For example, the various embodiments may be implemented using a multi-frequency reference, such as multiple frequencies per beacon 72 or direct measurement of the ranges between beacons 72 and the node 70. With respect to multi-frequency embodiments, these embodiments may be used, for example, when beacons 72 may need wide ranging a priori unknown reference frequencies. Additionally, the various embodiments may be implemented in the RF or acoustic operating frequencies.

In particular, as noted herein, node $\vec{a}_n$ has to measure the phase shift $\kappa c_j|\vec{a}_n-\vec{b}_j|$ representing the distance $|\vec{a}_n-\vec{b}_j|$ between the node and beacon $\vec{b}_j$ for the affine coefficient $c_j$ and desired array wave number $\kappa$. As described herein, the reference signal from $\vec{b}_j$ may be transmitted at wave-number $\kappa_j=\kappa|c_j|$. In some circumstances, this transmission may be inconvenient for $c_j$ and may, in principle, be any real number. If $c_j$ were an integer, then operation may be provided at $\kappa$ and then the $c_j^{th}$ power of the measured phasor may be used. However, if $c_j$ is not an integer, then the exponentiation is multi-valued. Accordingly, then $\kappa_j=\kappa|c_j|$ represents the linear sum of integer multiples of convenient wave numbers, namely frequencies that can be used. For example, if the desired frequency $$\frac{\omega}{2\pi}=\frac{\kappa}{c}$$

is at 1000 MHz, and the affine coefficient $c_j\sim0.1$, then the beacon reference is at around 100 MHz, which may be very inconvenient for requiring very wide bandwidth transceivers. Instead, assume reference frequencies may be provided from 900 MHz to 1100 MHz. Accordingly, the reference is 1050−950=100 MHz and this embodiment transmits from beacon $\vec{b}_j$ first at a 1050 MHz and then at 950 MHz reference. Thereafter, the conjugate of the second phasor is multiplied with that of the first, and the result is a phasor as if 100 MHz had been transmitted, as long as the distance between the beacon and the node does not change. This scheme works because a common phase delay for all the array nodes has no influence on the coherence of the wavefront.

As another example, let $c_j\sim0.707$, and the desired reference would then be at 707 MHz, which may be out of the allowed band. Instead, this embodiment generates 707=5×967−4×1032 and proceeds as follows. First, a reference is transmitted at 967 MHz, and in the receiver the $5^{th}$ power of the received phasor is used. Thereafter, a 1032 MHz reference is transmitted and the $4^{th}$ power of the conjugate of the received phasor is used. Thereafter, the two phasors are multiplied and the result is just the phasor for 707 MHz. Integer powers of complex numbers may be taken because the result is unique.

Further, let $(\kappa_{min},\kappa_{max})$ denote the interval in which the beacons 72 may operate. Using previously described notations, the phasor $p_{nj}=e^{-\iota\kappa c_j|\vec{a}_n-\vec{b}_j|}$ is measured in two steps by representing the wave number $\kappa_j=\kappa|c_j|$ as the linear sum with integer coefficients $\kappa_j=m'_j\kappa'_j+m''_j\kappa''_j$, where $m'_j$ and $m''_j$ are integers, and $\kappa'_j$ and $\kappa''_j$ wave numbers that fall in the interval $(\kappa_{min},\kappa_{max})$. First, the beacon $\vec{b}_j$ sends $\kappa'_j$ and the corresponding phasor $p'_{nj}=e^{-\iota\kappa'_j|\vec{a}_n-\vec{b}_j|}$ is measured by node $\vec{a}_n$, after which the beacon 72 sends $\kappa''_j$ and the phasor $p''_{nj}=e^{-\iota\kappa''_j|\vec{a}_n-\vec{b}_j|}$ is measured. Having measured both waves, the receiver calculates the product $(p'_{nj})^{m'_j}(p''_{nj})^{m''_j}$ that is exactly $p_{nj}=e^{-\iota\kappa c_j|\vec{a}_n-\vec{b}_j|}$ because the exponents $m'_j$ and $m''_j$ are integers. It should be noted that if one of these integers is negative, then the complex conjugate of the phasor is taken without affecting the uniqueness of the result.

Moreover, the representation of the reference frequency as a linear combination of other frequencies with integer coefficients is not unique, but because multiplication increases proportionally with the oscillator phase noise, the coefficients should be provided as small integers. Also, more than two terms, $\kappa_j = m'_j\kappa'_j + m''_j\kappa''_j + m'''_j\kappa'''_j + \ldots$ may be employed. However, in various embodiments the number of terms is reduced or minimized because the measurement time is proportional to the number of beacon emissions.

The selection of the beacon calibration frequencies as a linear combination with integer coefficients to generate the array transmit phasor will allow the array node transceivers to operate, for example, not only in hostile or emission regulated environment, but also in full duplex, simultaneous transmit and receive mode when combined with appropriate filtering.

Conventional retrodirectivity being the 1D special case of the 3D linear phase decomposition described herein can also use this multi-frequency approach to calibrate corresponding nodes.

As another example, wherein the focus is scanned using a discrete raster, more than three beacons may be used, $m \geq 4$. In these embodiments, the target's direction vector is decomposed into more than three affine components, $\vec{R}_l^0 = c_1\vec{b}_1^0 + c_2\vec{b}_2^0 + c_3\vec{b}_3^0 + \ldots + c_m\vec{b}_m^0$, but unlike having unique decomposition into three directions in three dimensions, when at least four references vectors are used, the decomposition has $m-3$ excess parameters that can be adjusted to meet goals such as controlling the emission frequencies, i.e., wave-number $\kappa_j = \kappa|c_j|$ to be a convenient one, or the direction of grating globes, or improved near field focusing. Changing the origin of the coordinate system also effects the affine coefficients, hence, on the required beacon frequencies, and can be used to vary the operating frequencies according to, for example, regulatory and interference environment requirements. For example, if $[\vec{b}_1^0|\vec{b}_2^0|\vec{b}_3^0]$ denotes the 3×3 matrix obtained from concatenation of the column vectors $\vec{b}_j^0$, then, the affine decomposition can be written as the matrix-vector product $$\vec{R}_t^0 = [\vec{b}_1^0|\vec{b}_2^0|\vec{b}_3^0]\begin{bmatrix} c_1 \\ c_2 \\ c_3 \end{bmatrix}$$

and the three affine coefficients can be determined by direct matrix inversion:

$$\begin{bmatrix} c_1 \\ c_2 \\ c_3 \end{bmatrix} = [\vec{b}_1^0|\vec{b}_2^0|\vec{b}_3^0]^{-1}\vec{R}_t^0 \qquad \text{Eq. 18}$$

If there is a $4^{th}$ beacon of opportunity in a given direction $\vec{b}_4^0$ operating at a fixed frequency (wave-number), such as $\kappa_4$ not under the control of the array, then to form an affine frame with three beacons whose emissions can be controlled and with this $4^{th}$ one $$c_4 = \frac{\kappa_4}{\kappa}$$

is set, as $$c_4\vec{b}_4^0 = \frac{\kappa_4}{\kappa}\vec{b}_4^0$$

is subtracted from $\vec{R}_t^0$ and the matrix inversion as in Equation 18 is applied to calculate the affine coefficients now for $\vec{R}_t^0 - c_4\vec{b}_4^0 = c_1\vec{b}_1^0 + c_2\vec{b}_2^0 + c_3\vec{b}_3^0$, etc.

The affine decomposition of the target's direction vector $\vec{R}_t^0$ also may be defined as the vector sum $\vec{R}_t^0 = c_1\vec{b}_1^0 + c_2\vec{b}_2^0 + \ldots + c_m\vec{b}_m^0$. Thereafter, the $j^{th}$ affine component is scaled with a coefficient with a real number $\mu_j$ as $c_j \rightarrow \mu_j c_j$. The resulting direction vector $\vec{R}_t^0 \rightarrow \vec{R}_t^{\mu 0}$ then may be determined as described below. By definition $\vec{R}_t^{\mu} = \mu_1 c_1\vec{b}_1^0 + \mu_2 c_2\vec{b}_2^0 + \ldots + \mu_m c_m\vec{b}_m^0$. However, this $\vec{R}_t^{\mu}$ is not necessarily a unit vector. In order to obtain the direction vector, both sides of the equation are divided by the corresponding magnitude $|\vec{R}_t^{\mu}|$:

$$\begin{aligned}\vec{R}_t^{\mu 0} &= \frac{\mu_1}{|\vec{R}_t^{\mu}|}c_1\vec{b}_1^0 + \frac{\mu_2}{|\vec{R}_t^{\mu}|}c_2\vec{b}_2^0 + \ldots + \frac{\mu_m}{|\vec{R}_t^{\mu}|}c_m\vec{b}_m^0 \\ &= l_1c_1\vec{b}_1^0 + l_2c_2\vec{b}_2^0 + \ldots + l_mc_m\vec{b}_m^0.\end{aligned} \qquad \text{Eq. 19}$$

The $\vec{R}_t^{\mu}$ and $\vec{R}_t^{\mu 0}$ would be the new focus and focal direction, respectively, if the measurements were taken from the beacons with the new affine coefficients $$\frac{\mu_j}{|\vec{R}_{\mu t}^{\mu}|}c_j = l_jc_j.$$

But, if any of the scale factors $$\frac{\mu_j}{|\vec{R}_{\mu t}|} = l_j$$

is an integer, then the prior measurement from beacon j may be reused by taking the $l_j^{th}$ power of the corresponding phasor. It should be noted that $l_j$ may not necessarily be integers, and accordingly are made to be integers as described herein.

With $\vec{R}_t^{\mu 0}$ being a unit vector, the component-wise 3D decomposition is defined as follows:

$$\begin{aligned}&[\vec{R}_t^{\mu 0}]_i = l_1c_1[\vec{b}_1^0]_i + l_2c_2[\vec{b}_2^0]_i + \ldots + l_mc_m[\vec{b}_m^0]_i \\ &[\vec{b}_j^0]_i = B_{ij} \\ &\sum_{i=1}^{3}(l_1c_1B_{i1} + l_2c_2B_{i2} + \ldots + l_mc_mB_{im})^2 = 1\end{aligned} \qquad \text{Eq. 20}$$

The first $m-1$ coefficients are set to be integers $I_1, I_2, \ldots, I_{m-1}$ and $l_m$ is determined such that Equation 20 is satisfied with $l_l=I_1$, $l_2=I_2$, . . . , $l_{m-1}=I_{m-1}$, which is substituted into Equation 20 to obtain the following:

$$1 = \sum_{i=1}^{3} (I_1 c_1 B_{i1} + I_2 c_2 B_{i2} + \ldots + I_{m-1} c_{m-1} B_{im-1} + l_m c_m B_{im})^2 \quad \text{Eq. 21}$$

This is a simple quadratic equation that is solved for $l_m$ given the integer set $I_1, I_2, \ldots, I_{m-1}$. It should be noted that the solution may not be a real number or an integer. However, if the solution is a real number, then the j=1, 2, . . . , m−1 phasors can be reused from prior measurements and only the $m^{th}$ reference will have to be re-measured directly at a new frequency corresponding to the noninteger $l_m$-fold frequency scaling. If no real number solution exists, then the j=1, 2, . . . , m−2 coefficients may be forced to be integers while leaving $l_{m-1}$ and $l_m$ to be unconstrained. It should be noted that the integer constrained and unconstrained coefficients may be permuted to optimize the solution.

A pulse mode embodiment in the time domain also may be provided. For example, various embodiments can also operate in pulse mode, namely poly-chromatic and not only mono-chromatic.

In particular, if at frequency ω the differential wavelet of complex amplitude $S_n(\omega)d\omega$ is to be synthesized and sent from node n to arrive at the target in phase with the other wavelets, then the beacons use reference frequencies $c_j\omega$ of some arbitrary complex amplitude $M_j(\omega)$. Because of the propagation delay $\tau_{nj}$ between the beacon and array node, the complex amplitude has phase shift and becomes $M_j(\omega)e^{-Ic_j\omega\tau_{nj}}$, which results from the following expansion $$\omega T_n \cong \kappa|\vec{R}_t| - \sum_{j=1}^{3} \kappa_j|\vec{b}_j| + \sum_{j=1}^{3} \kappa_j|\vec{a}_n - \vec{b}_j| \quad \text{Eq. 23}$$

The phase delay may be substituted with $\omega\tau_{nj}=\kappa|\vec{a}_n-\vec{b}_j|$ between the beacon j and node n, and noting that the wavelet $S_n(\omega)d\omega$ experiences phase shift $\omega\tau_n$ and the wavelet arrives to the target as follows:

$$S_n(\omega)e^{-i\omega T_n} \cong \exp\left[-i\kappa|\vec{R}_t| + i\sum_{j=1}^{3} \kappa_j|\vec{b}_j|\right] S_n(\omega)\prod_{j=1}^{3} e^{-ic_j\omega T_{nj}} \quad \text{Eq. 24}$$

If the phase of the product $$S_n(\omega)\prod_{j=1}^{3} e^{-ic_j\omega T_{nj}} = E_0$$

is made independent of the node index n, then the wavelets from all the nodes 70 will add up in phase, and $$S_n(\omega) = E_0\prod_{j=1}^{3} e^{ic_j\omega T_{nj}}.$$

Upon summation, the wavelets are multiplied by a node independent phasor $e^{-i\psi_0}$, $$\psi_0 = \kappa|\vec{R}_t| - \sum_{j=1}^{3} \kappa_j|\vec{b}_j|,$$

to obtain the composite waveform, a finite pulse, $$w(t) = e^{-i\psi_0}\sum_n s_n(t).$$

The multiplication by $e^{-i\psi_0}$ can be omitted it being a common factor.

Thus, the amplitudes of the received reference wavelets $M_j(\omega)e^{-Ic_j\omega\tau_{nj}}$ are multiplied together $$\prod_{j=1}^{3} M_j(\omega)e^{-ic_j\omega\tau_{nj}},$$

and the complex conjugate of this product is determined, with the complex amplitude of the wavelet set to be equal with the following $$S_n(\omega) = \prod_{j=1}^{3} \overline{M}_j(\omega)e^{ic_j\omega\tau_{nj}}.$$

The actual waveform, which is a finite length pulse from node n, is then the Fourier integral of these wavelets:

$$s_n(t) = \frac{1}{2\pi}\int_{-\infty}^{\infty} S_n(\omega)e^{i\omega t}\,d\omega = \frac{1}{2\pi}\int_{-\infty}^{\infty}\prod_{j=1}^{3} \overline{M}_j(\omega)e^{ic_j\omega\tau_{nj}}e^{i\omega t}\,d\omega \quad \text{Eq. 26}$$

The basic time domain reference waveform of beacon j may be denoted by $$m_j(t) = \frac{1}{2\pi}\int_{-\infty}^{\infty} M_j(\omega)e^{i\omega t}\,d\omega,$$

then:

$$m_j(c_j t) = \frac{1}{2\pi}\int_{-\infty}^{\infty} M_j(\omega)e^{ic_j\omega\tau}\,d\omega \quad \text{Eq. 27}$$

showing that scaling the carrier frequency of each wavelet with the affine coefficient $c_j$, the waveform is stretched in time with the same scale. Because the signal experiences delay $\tau_{nj}$ the received waveform is both stretched and delayed:

$$m_j(c_j t - c_j\tau_{nj}) = \frac{1}{2\pi}\int_{-\infty}^{\infty} M_j(\omega)e^{-ic_j\omega\tau_{nj}}e^{ic_j\omega\tau}\,d\omega \quad \text{Eq. 28}$$

It should be noted that the receiver conjugates each wavelet. The corresponding time waveform is determined as follows. Taking the complex conjugate of both sides results in $$\overline{m}_j(c_j t - c_j \tau_{nj}) = \frac{1}{2\pi}\int_{-\infty}^{\infty} \overline{M}_j(\omega) e^{ic_j\omega\tau_{nj}} e^{-ic_j\omega t} d\omega,$$

or upon substituting −t for t:

$$\overline{m}_j(-c_j t - c_j \tau_{nj}) = \frac{1}{2\pi}\int_{-\infty}^{\infty} \overline{M}_j(\omega) e^{ic_j\omega\tau_{nj}} e^{ic_j\omega t} d\omega \quad \text{Eq. 29}$$

which is the conjugate, delayed and time reversed form of the waveform from the beacon. It should be noted that conjugation in the frequency domain is equivalent to reversal in time domain. The transmitted waveform being real function of time $m_j(t)=\overline{m}_j(t)$:

$$m_j(-c_j t - c_j \tau_{nj}) = \frac{1}{2\pi}\int_{-\infty}^{\infty} \overline{M}_j(\omega) e^{ic_j\omega\tau_{nj}} e^{ic_j\omega t} d\omega \quad \text{Eq. 30}$$

If the pulse length is less than $T_m$, $m_j(t)=0$ when $t<0$ or $t>T_m$, then the receivers may maintain causality by further delaying the signals by $h_m T_m$ before reversal and transmission $m_j(h_m T_m - c_j t - c_j \tau T_{nj})$ for some large enough $h_m>1$. When the Fourier amplitudes are multiplied the corresponding time domain waveforms are convolved:

$$\begin{aligned} s_n(t) &= \frac{1}{2\pi}\int_{-\infty}^{\infty} S_n(\omega) e^{i\omega t} d\omega \quad \text{Eq. 31} \\ &= \frac{1}{2\pi}\int_{-\infty}^{\infty} \prod_{j=1}^{3} \overline{M}_j(\omega) e^{ic_j\omega\tau_{nj}} e^{i\omega t} d\omega \\ &= \overline{m}_1(-c_1 t - c_1\tau_{n1}) \otimes \overline{m}_1(-c_2 t - c_2\tau_{n2}) \otimes \overline{m}_3(-c_3 t - c_3\tau_{n3}) \end{aligned}$$

The above is the waveform that the array node n transmits. After summation, the composite waveform at the focus is obtained, namely the pulse $$w(t) = \sum_n s_n(t)$$

that the target sees aside from the irrelevant common phase factor $e^{-i\psi_0}$.

Thus, using the formula $$s_n(t) = \bigotimes_{j=1,2,3} \overline{m}_j(-c_j(t+\tau_{nj})),$$

the field may be scanned by having beacon j transmit $m_j(t)$ and the transmission be measured by node n as $m_j(t-\tau_{nj})$, after which the node time reverts and compresses the transmission in time according to the affine coefficient $c_j$ to obtain $\overline{m}_j(-c_j(t+\tau_{nj}))$. Using this signal processing, the array can scan to any field point by explicit scaling of the pulse once the nodes have received the calibration pulses appropriate to the desired focal point.

Accordingly, the terms in the summation for w(t) are all in phase, and therefore the pulsed wavefront is, to a $1^{st}$ order approximation, focused on the target in the far field.

Thus, in accordance with various embodiments, in operation, the reference beacons use known frequencies with known waveforms and have emissions that are phase stable during the course of array calibration. The array, while aligning the phases of the nodes, can use the emitted signals of, for example, cellular base stations, TV or radio stations, radars, etc. that are at known locations and of known frequency. This can simplify and in some cases obviate the deployment of many reference emitters.

If only one beacon is used, the method reverts to the retro-directive 1D scheme in which phase coherence is established in the direction of and at the point of the beacon.

If only two beacons are used then the direction vectors of the beacons span a plane (2D) and not the full space (3D) and the target's direction vector drawn from the same reference point must lie in the same plane so that the phase cohered beam can be pointed in its direction.

Thus, one or several transmit beacons can also receive and verify the quality of a beam, which may be implemented using the transceivers of the nodes 70 as beacons 72 and have the rest of the references configured as the above described fixed civilian installations as emitters, thereby improving beam forming.

In some embodiments, shifting of the origin is provided. Specifically, control over the affine coefficients and the corresponding beacon frequencies may be provided by shifting the origin of reference coordinate system. For example, if the decomposition $\vec{R}_t^{\,0}=c_1\vec{b}_1^{\,0}+c_2\vec{b}_2^{\,0}+c_3\vec{b}_3^{\,0}$ is provided, but the $c_j$ and $\kappa_j$ need to be or are desired to be changed, the origin may be shifted to a new location denoted by the vector $\vec{g}$. Then, the vectors representing the target and the beacons will be $\vec{R}_t+\vec{g}$ and $\vec{b}_j+\vec{g}$, respectively. The corresponding new affine coefficients $c'_j$ will be:

$$\begin{aligned} c'_j &= (\vec{R}_t+\vec{g})\cdot(\vec{b}_j+\vec{g})\frac{1}{|\vec{R}_t+\vec{g}||\vec{b}_j+\vec{g}|} \quad \text{Eq. 32} \\ &= \left(c_j + \vec{g}\cdot\vec{b}_j^{\,0}\frac{1}{|\vec{R}_t|} + \vec{R}_t^{\,0}\cdot\vec{g}\frac{1}{|\vec{b}_j|} + \vec{g}\cdot\vec{g}\frac{1}{|\vec{b}_j|}\frac{1}{|\vec{R}_t|}\right) \\ &\quad \frac{|\vec{R}_t||\vec{b}_j|}{|\vec{R}_t+\vec{g}||\vec{b}_j+\vec{g}|} \end{aligned}$$

It should be noted that the above depends on the location of the new reference point $\vec{g}$. Because the curvature error is larger the further the origin is from the nodes, the magnitude of $\vec{g}$ cannot be increased arbitrarily. Such origin shifting, however, allows some amount of fine tuning of the beacon frequencies.

To apply Equation 14, the full phase synchronism among the nodes is first established, and the affine coordinates of the target in the beacon reference frame are known, as well as the spatial distribution of the beacons. Low accuracy spatial distribution of the nodes is needed only to apply the near field quadratic error correction to the far field plane waves when the target or beacons are in the near field of the array. The beacons 72 need not be phase synchronous with the nodes 70 nor with each other.

Focusing error is caused by phase errors in $E_n=e^{i\theta_{n0}}s_{n1}s_{n2}s_{n3}$. The phase of $s_{n1}s_{n2}s_{n3}$ depends only on phase noise of and mutual synchronization errors between the nodes, that being the accuracy of the $p_{jn}$ measurements, and does not depend directly on the assumed locations, or node 70 to node 70, or node 70 to beacon 72 distances. It does depend on the accuracy with which the target is known relative to the beacon frame, that is, the accuracy of the affine coordinates $c_1, c_2, c_3$; which is unavoidable as the array must know where to focus.

Thus, Equations 13 and 14 may be viewed as representing a converging lens that has three partial object foci of three different colors and one full image focus of a fourth color that obtains only when all three object colors are present. The lens consists of the randomly located array of nodes while the reference beacons are placed in the object foci. The refractive index is represented by the phase shifts the nodes impose on the wave if the wave were to propagate from the beacon to the target. Besides the desired image focus there are other lower level spurious images, diffraction side-lobes caused by the undersampling of the array aperture. Because of the coherent wavefront processing the mixture of the three colors is a genuine fourth color, unlike in television, for example, where the intensity mixing of the primary "RGB" colors only appear to the viewer to be a fourth one, when in fact there is no EM wave created with wavelength corresponding to the apparent color.

Because of the affine decomposition $\vec{R}_t^{\,0}=c_1\vec{b}_1^{\,0}+c_2\vec{b}_2^{\,0}+c_3\vec{b}_3^{\,0}$ the decomposition of the desired transmit phase as a linear sum of directly measurable phases can be expressed as vector equality among the ray vectors:

$$\vec{\kappa}=\vec{\kappa}_1+\vec{\kappa}_2+\vec{\kappa}_3 \qquad \text{Eq. 33}$$

where $\vec{\kappa}=\kappa\vec{R}_t^{\,0}$ is the ray vector from the array to the target, and $\vec{\kappa}_j=\kappa_j\vec{b}_j^{\,0}=c_j\kappa\vec{b}_j^{\,0}$ is the ray vector from beacon j to the array. Equation 33 expresses the conservation of momentum between the calibration photons emitted from the beacons towards the array and the one emitted by the array towards the target. Special cases of Equation 33 are present, for example, in conjunction with four-wave mixing, whereby light from two high intensity laser sources is injected into a crystal. The high intensity phase locked sources, pumps, emit light in parallel, but opposing direction (anti-parallel). Upon scattering a third so-called probe light of the same frequency a fourth wave was generated in the interaction volume. From the momentum and energy conservation laws follows that the $4^{th}$ wave is at the same frequency and phase conjugate reflection of the probe and must be anti-parallel as it merges. This result can be used in image processing to compensate for propagation medium induced aberrations. It should be noted that various embodiments do not assume parallelism or common frequency of operation among the waves.

Figure 9:
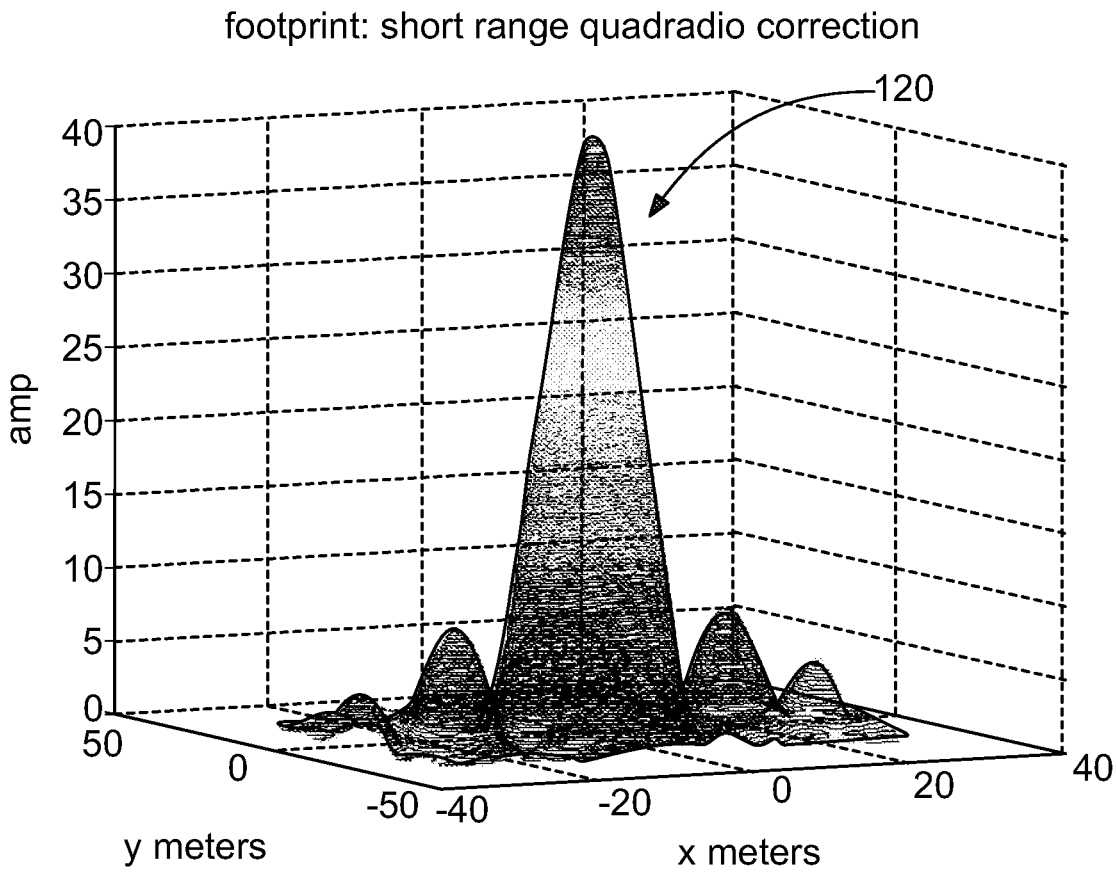
FIG. 9 is a three-dimensional plot illustrating a beam footprint in accordance with various embodiments with quadratic phase error correction included.

FIG. 9 illustrates a 3D plot 120 of the beam footprint for a short range scenario with quadratic phase error correction included. It should be noted that the beam is perfectly constructed and if in this scenario the quadratic phase error were not compensated, the peak would drop by 6 dB. Although the quadratic error correction formula Equation 13 explicitly contains the location of the nodes, the Equation is insensitive to the precision with which those positions are known: when the nodes are randomly displaced from the nominal location of the nodes with 4 m standard deviation, the peak of the beam drops only by 0.4 dB with similar variation in the sidelobes.

The various embodiments may be implemented in connection with, for example, the WNaN platform that allows for dedicating two large DSP cores to the phase, frequency and time alignment for the array focusing methods of the various embodiments. A modem may use the FPGA cores independently of the DSP and therefore maintains communication links between nodes 70 while the beacons 72 or, for example, jamming signals are generated. The phase extraction methods of the beacons 72 may be provided in a DSP, and some of the signal processing may be ported to the FPGA to increase parallelism and reduce latency.

A WNaN radio is also capable of dedicating, for example, two transceivers to communicate, inheriting from an existing network stack, and uses two other transceivers simultaneously to decode beacons 72 and to send, for example, jamming signals in accordance with various embodiments. This platform also offers GPS time based alignment and 3D accelerometer sensing with an integration process that may used as described herein.

Figure 10:
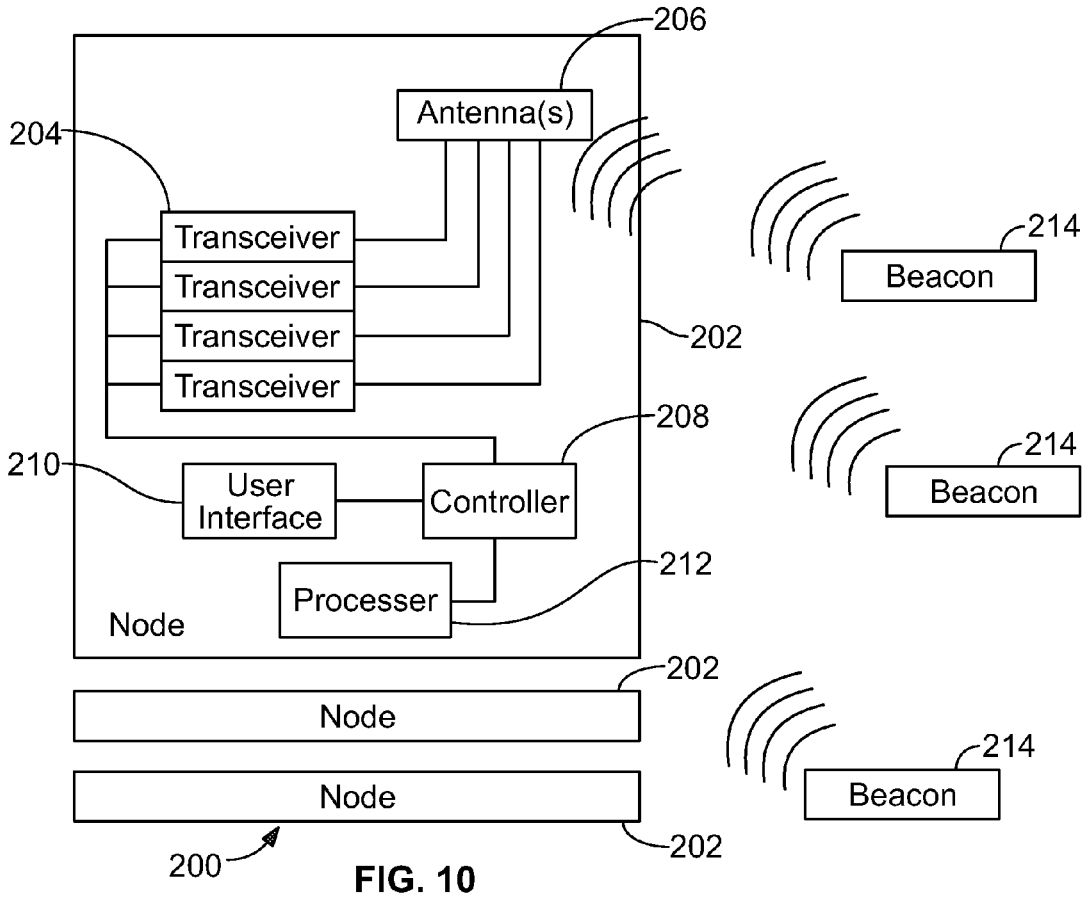
FIG. 10 is a block diagram of system formed in accordance with various embodiments.

In various embodiments a system 200, for example, a coherent wavefront generation system may be provided as illustrated in FIG. 10 that allows aiming and/or focusing of phase coherent energy at any direction and any frequency. The system 200 may be configured to operate in accordance with any of the embodiments described herein. The system 200 includes one or more radios 202 (three radios 202 are illustrated as three nodes). The radios 202 include a plurality of transceivers 204 (four transceivers 204 are illustrated) connected to one or more antennas 206 (which may optionally include an attached accelerometer as described herein). A controller 208 is connected to a user interface 210 that is configured to receive user inputs and allow interaction with the user. Additionally, a processor 212 is connected to the controller 208 to control the operation of the transceivers 204 that communicate with a plurality of beacons 214 (which may be any type of beacons) to provide array focusing in accordance with one or more embodiments described herein. Using the system 200, the beacons 214, which may operate as reference beacons do not have to be placed at or near the desired focal point (as is the case of 1D retrodirectivity). It should be noted that the radios 202 and beacons 214 may be positioned or located randomly or at desired locations (e.g., easier accessible locations).

Figure 11:
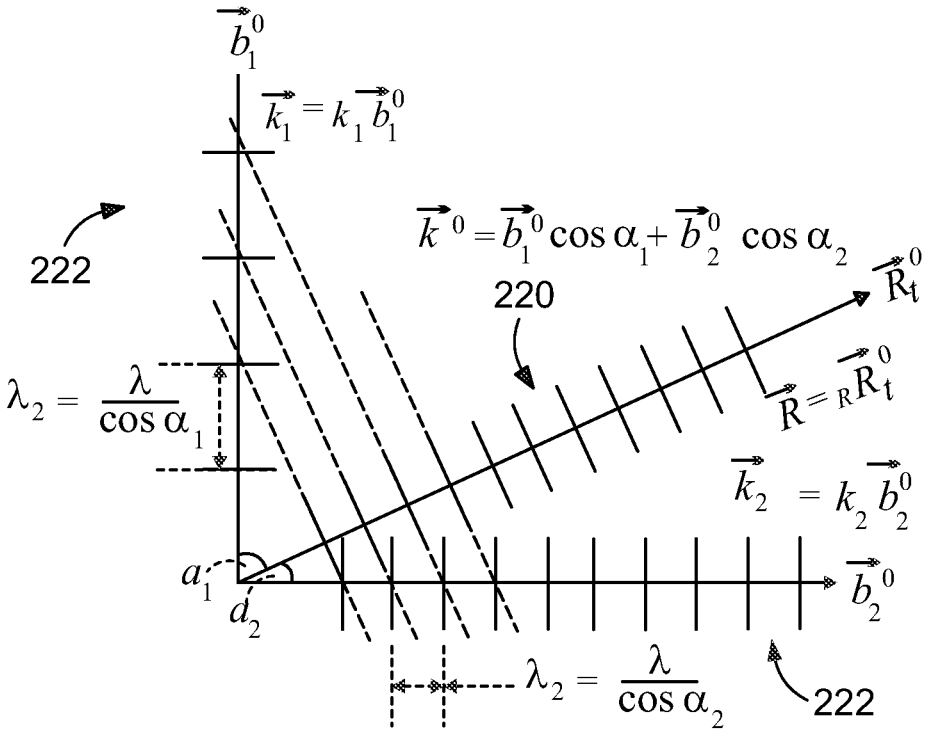
FIG. 11 is a diagram illustrating a special case of two-dimensional beam directing and focusing, and the use of different frequencies (wavelengths) in accordance with various embodiments.

Shown in FIG. 11 are the target direction vector 220 and the beacon direction vectors 222 that for simplicity of this illustration are assumed to be perpendicular. The ray vector 220 is projected in the affine base of direction vectors 222. The projected "rate of crests and troughs" is then direction dependent and to recreate the same rate along the base ray, wave vectors of a different frequency are propagated. Because the wavefronts are always perpendicular to the ray vectors, the rate of crests and troughs of the wavefronts of the direction vectors 222 are not the same as that of the wavefronts of the target direction vector 220. Only when these wavefronts are parallel and the rays point in the same direction, do these have the same rate and wave number.

Figure 12:
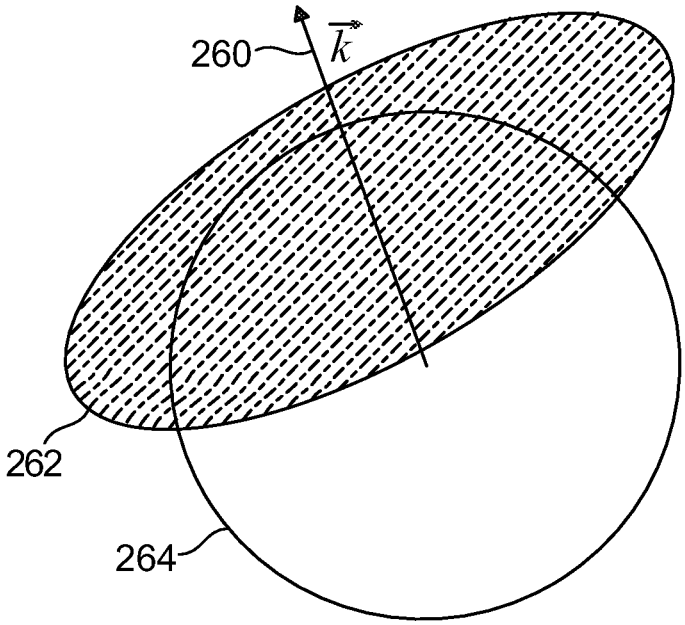
FIG. 12 is a diagram illustrating plane and spherical waves

FIG. 12, thus, illustrates that at any point of the ray 260, the plane wave approximation is represented by a plane wavefront 262 that is tangential to the spherical wavefront 264.

The various embodiments and/or components, for example, the modules, radios, or components or controllers, also may be implemented as part of one or more computers or processors. The computer or processor may include a computing device, an input device, a display unit and an interface, for example, for accessing the Internet. The computer or processor may include a microprocessor. The microprocessor may be connected to a communication bus. The computer or processor may also include a memory. The memory may include Random Access Memory (RAM) and Read Only Memory (ROM). The computer or processor further may include a storage device, which may be a hard disk drive or a removable storage drive such as a floppy disk drive, optical disk drive, and the like. The storage device may also be other similar means for loading computer programs or other instructions into the computer or processor.

As used herein, the term "computer" or "module" may include any processor-based or microprocessor-based system including systems using microcontrollers, reduced instruction set computers (RISC), application specific integrated circuits (ASICs), logic circuits, and any other circuit or processor capable of executing the functions described herein. The above examples are exemplary only, and are thus not intended to limit in any way the definition and/or meaning of the term "computer".

The computer or processor executes a set of instructions that are stored in one or more storage elements, to process input data. The storage elements may also store data or other information as desired or needed. The storage element may be in the form of an information source or a physical memory element within a processing machine.

The set of instructions may include various commands that instruct the computer or processor as a processing machine to perform specific operations such as the methods and processes of the various embodiments of the invention. The set of instructions may be in the form of a software program. The software may be in various forms such as system software or application software. Further, the software may be in the form of a collection of separate programs or modules, a program module within a larger program or a portion of a program module. The software also may include modular programming in the form of object-oriented programming. The processing of input data by the processing machine may be in response to operator commands, or in response to results of previous processing, or in response to a request made by another processing machine.

As used herein, the terms "software" and "firmware" are interchangeable, and include any computer program stored in memory for execution by a computer, including RAM memory, ROM memory, EPROM memory, EEPROM memory, and non-volatile RAM (NVRAM) memory. The above memory types are exemplary only, and are thus not limiting as to the types of memory usable for storage of a computer program.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the invention without departing from their scope. While the dimensions and types of materials described herein are intended to define the parameters of the various embodiments of the invention, the embodiments are by no means limiting and are exemplary embodiments. Many other embodiments will be apparent to those of skill in the art upon reviewing the above description. The scope of the various embodiments of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments of the invention, including the best mode, and also to enable any person skilled in the art to practice the various embodiments of the invention, including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. A method of array focusing, the method comprising:

providing a plurality of transceivers configured to transmit signals and defining an array of nodes; and providing a plurality of beacons configured to transmit waves at different frequencies to the array of nodes to one of aim or focus phase coherent energy generated from the plurality of transceivers of the array, the phase coherent energy transmitted at a direction and at a frequency that are controlled by the transmit frequencies of the plurality of beacons that are located arbitrarily with respect to a desired focal point, wherein the signals transmitted from the plurality of transceivers are constructively combined at an arbitrary direction in point and space independent of locations of the plurality of beacons.

2. A method in accordance with claim 1 wherein to focus a beam anywhere in a plane spanned by two beacons and an arbitrary coplanar reference point.

3. A method in accordance with claim 1 wherein the beacons comprise at least three beacons and arbitrary non-coplanar reference point to focus the beam in any direction of space to operate for three-dimensional scanning.

4. A method in accordance with claim 1 further comprising configuring the beacons to operate as test receivers to determine coherence of the array.

5. A method in accordance with claim 1 wherein the plurality of beacons comprise a plurality of primary beacons and further comprising providing a plurality of secondary beacons configured as fixed emitters operating at a fixed and different frequency than the plurality of beacons, and wherein a plurality of additional primary beacons are configured to provide adjustable location dependent frequencies such that the frequencies are different based on a location thereof.

6. A method in accordance with claim 1 wherein the plurality of transceivers include antennas with corresponding accelerometers coupled thereto, and further comprising configuring the transceivers to use the sensed motion to reset direct phase measurements between the plurality of transceivers.

7. A method in accordance with claim 1 further comprising randomly locating the plurality of transceivers.

8. A method in accordance with claim 1 further comprising configuring the plurality of transceivers for frequency locking and phase locking therebetween.

9. A method in accordance with claim 1 further comprising configuring the array of nodes formed from the plurality of transceivers to periodically transmit a coherent wavefront in the direction of the plurality of beacons, wherein the coherent wavefront is created by referencing an arbitrary target location relative to the array of nodes, transmitting a calibration signal from the plurality of beacons to the plurality of nodes, receiving the calibration signal at the plurality of nodes, calculating a wavefront curvature correction, and transmitting a complex amplitude signal from the array nodes as the coherent wavefront.

10. A method in accordance with claim 1 further comprising providing an oscillator clock associated with one of the transceivers to lock corresponding clocks associated with the other transceivers, and providing a global positioning system (GPS) device for initial position estimation.

11. A method in accordance with claim 1 further comprising decomposing desired transmit phases of the nodes into linear combinations of received phases from the plurality of beacons.

12. A method in accordance with claim 1 further comprising configuring one or more beacons of the plurality of beacons as single frequency references.

13. A method in accordance with claim 1 further comprising configuring the plurality of beacons as multi-frequency references.

14. A method in accordance with claim 1 further comprising at least four beacons and further comprising decomposing a direction vector of a target into more than three affine components.

15. A method in accordance with claim 1 further comprising shifting an origin of a reference coordinate system for the frequencies of the plurality of beacons to point to the plurality of beacons.

16. A method in accordance with claim 1 further comprising configuring the plurality of transceivers to scan a focus of the phase coherent energy using a discrete raster scanning pattern.

17. A method in accordance with claim 1 further comprising configuring the plurality of transceivers to operate in pulse mode.

18. A system for array focusing, the system comprising:

at least one radio having a plurality of transceivers configured to transmit signals, the plurality of transceivers defining an array of nodes; and a plurality of beacons configured to operate at different frequencies to aim or focus phase coherent energy generated by the transmitted signals from the plurality of transceivers, wherein the phase coherent energy is transmitted at a direction and a frequency determined with phase conjugation and independent of the location of the plurality of beacons.

19. A system in accordance with claim 18 wherein the plurality of beacons comprise three beacons configured to be used to measure an array phase distribution as a function of direction.

* * * * *